US008285189B2

(12) United States Patent
Matsuzaki et al.

(10) Patent No.: US 8,285,189 B2
(45) **Date of Patent: *Oct. 9, 2012**

(54) CLEANING DEVICE, DEVELOPING DEVICE, CARTRIDGE, CLEANING BLADE SECURING METHOD, AND DEVELOPING BLADE SECURING METHOD

(75) Inventors: Hiroomi Matsuzaki, Mishima (JP); Akira Suzuki, Naka-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/270,567

(22) Filed: Oct. 11, 2011

(65) Prior Publication Data

US 2012/0027458 A1 Feb. 2, 2012

Related U.S. Application Data

(62) Division of application No. 12/711,500, filed on Feb. 24, 2010, now Pat. No. 8,073,377.

(30) Foreign Application Priority Data

Feb. 27, 2009 (JP) ..... 2009-046386
Dec. 17, 2009 (JP) ..... 2009-286066

(51) Int. Cl.
*G03G 21/00* (2006.01)

(52) U.S. Cl. ..... 399/351; 399/284; 411/23; 411/82.1

(58) Field of Classification Search ..... 399/123, 399/283–284, 343, 350–351; 411/15, 19, 411/21–23, 32–33, 82, 82.1
See application file for complete search history.

(56) References Cited

U.S. PATENT DOCUMENTS

| | | | | |
|---|---|---|---|---|
| 4,575,219 | A | 3/1986 | Tomita et al. | |
| 5,161,916 | A * | 11/1992 | White et al. | 405/259.6 |
| 5,991,568 | A | 11/1999 | Ziegelmuller et al. | |
| 6,128,462 | A | 10/2000 | Kato et al. | |
| 6,266,502 | B1 | 7/2001 | Matsuzaki et al. | |
| 6,528,158 | B1 | 3/2003 | Kuroda | |
| 2002/0001513 | A1 | 1/2002 | Tanaka | |

FOREIGN PATENT DOCUMENTS

JP 2003-177644 A 6/2003

OTHER PUBLICATIONS

Notification of the First Office Action dated Jul. 27, 2011, in Chinese Application No. 201010118866.4.

* cited by examiner

*Primary Examiner* — Walter L Lindsay, Jr.
*Assistant Examiner* — Benjamin Schmitt
(74) *Attorney, Agent, or Firm* — Fitzpatrick, Cella, Harper & Scinto

(57) ABSTRACT

A cleaning device includes a cleaning blade for removing toner remaining on a surface of an image bearing member for carrying a toner image; a supporting member for supporting the cleaning blade; a mounting hole provided in one of the cleaning blade and the supporting member; a projection which is provided on the other of the cleaning blade and the supporting member and which is inserted in the mounting hole; and a recess provided in the projection and extended from a free end portion of the projection toward a base portion of the projection, wherein the cleaning blade and the supporting member are secured to each other by the projection deformed such that the recess expands outwardly of the mounting hole by resin material in the recess.

8 Claims, 12 Drawing Sheets

(a)

(b)

(a)

(b)

(c)

(a)

(b)

(a)

(b)

CLEANING DEVICE, DEVELOPING DEVICE, CARTRIDGE, CLEANING BLADE SECURING METHOD, AND DEVELOPING BLADE SECURING METHOD

This application is a divisional of U.S. patent application Ser. No. 12/711,500, filed Feb. 24, 2010, now U.S. Pat. No. 8,073,377.

FIELD OF THE INVENTION AND RELATED ART

The present invention relates to a cleaning device, a developing device, a cartridge, a method for securing a cleaning blade, and a method for securing a development blade.

Here, a cleaning device (cleaning blade), and a developing device (development blade) are such apparatuses that are used in an electrophotographic image forming apparatus.

Further, an electrophotographic image forming apparatus is an apparatus for forming an image on a recording medium with the use of an electrophotographic image formation process. It includes an electrophotographic copying machine, an electrophotographic printer (LED printer, laser beam printer, etc., for example), an electrophotographic facsimile apparatus, an electrophotographic word processor, and the like.

Further, a cartridge means a process cartridge which contains a minimum of a developing means placed in the cartridge (shell) to make the developing means removably mountable in the main assembly of an image forming apparatus, or a process cartridge which contains an image bearing member, and a cleaning means for removing the developer on the peripheral surface of the image bearing member, which are integrally placed in the cartridge (shell) to make them removably mountable in the main assembly of an image forming apparatus.

Conventionally, a piece of metallic plate which supports a cleaning blade for removing the developer (which hereafter will be referred to as "toner"), or a piece of metallic plate which supports a developer regulating member for regulating the toner on a developer bearing member, are attached with the use of screws (Japanese Laid-open Patent Application 2003-177644; FIGS. 9 and 10).

However, using screws to attach the metallic plate sometimes creates the following problems. That is, when manufacturing metallic screws, some screws come out with tiny pieces of metal of which the screws are made of, or tiny pieces of metal with which the screws are plated. These tiny pieces of metal remain attached to the screws. Further, when manufacturing resin screws, some screws come out with tiny pieces of resin, and these tiny pieces of resin remain attached to the screws. Further, some of these screws are shipped out in a bundle. Thus, the screws rub against each other during shipping, and therefore, some of the tiny metallic or resin pieces sometimes become separated from the screws. Further, as these screws having tiny metallic or resin pieces are tightened, the tiny metallic or resin pieces sometimes separate from the screws as they come into contact with the screw driver. Moreover, some of the tiny pieces of metal or resin having separated from the screws fall into a process cartridge. This creates problems. That is, in the case of some process cartridges, their photosensitive drums, charge rollers, development rollers, etc., are disposed below where the abovementioned screws are attached, because of the structure of the process cartridges. Thus, it is possible that the separated tiny pieces of metal or resin will adhere to the photosensitive drums, charge rollers, development rollers, etc. Thus, a process for cleaning each cartridge, and/or a process for examining each cartridge, becomes necessary. Besides, in recent years, a required level of image quality has become higher and higher. Thus, in order to achieve the higher level of image quality, the cleaning process and/or the examining process has to be more rigidly carried out. Also in recent years, process cartridges have been substantially reduced in size, making it necessary to reduce in size the metallic plate for supporting the cleaning blade and developer regulating member.

SUMMARY OF THE INVENTION

The primary object of the present invention is to provide a cleaning device, a developing device, and a cartridge, to which a blade can be easily attached, and a blade attaching method which is easier than any of the conventional blade attaching methods.

According to an aspect of the present invention, there is provided a cleaning device comprising a cleaning blade for removing toner remaining on a surface of an image bearing member for carrying a toner image; a supporting member for supporting said cleaning blade; a mounting hole provided in one of said cleaning blade and said supporting member; a projection which is provided on the other of said cleaning blade and said supporting member and which is inserted in said mounting hole; and a recess provided in said projection and extended from a free end portion of said projection toward a base portion of said projection, wherein said cleaning blade and said supporting member are secured to each other by said projection deformed such that said recess expands outwardly of said mounting hole by resin material in said recess.

According to another aspect of the present invention, there is provided a developing device comprising a developing blade for regulating toner to be applied on a developing roller; a supporting member for supporting said developing blade; a mounting hole provided in one of said developing blade and said supporting member; a projection which is provided on the other of said developing blade and said supporting member and which is inserted in said mounting hole; and a recess provided in said projection and extended from a free end portion of said projection toward a base portion of said projection, wherein said developing blade and said supporting member are secured to each other by said projection deformed such that said recess expands outwardly of said mounting hole by resin material in said recess.

According to a further aspect of the present invention, there is provided a cleaning blade securing method for securing a cleaning blade for a cleaning device, wherein said cleaning blade is effective to remove toner remaining on a surface of an image bearing member for carrying a toner image, and said cleaning device includes a supporting member for supporting said cleaning blade; a mounting hole provided in one of said cleaning blade and said supporting member; a projection which is provided on the other of said cleaning blade and said supporting member and which is inserted in said mounting hole; a recess provided in said projection and extended from a free end portion of said projection toward a base portion of said projection, said method comprising steps of inserting said projection into said mounting hole; injecting molten resin material into said recess to deform said projection so as to expand said recess outwardly of said mounting hole by a pressure of the resin material; and curing the resin material to secure said cleaning blade to said supporting member.

According to a further aspect of the present invention, there is provided a developing blade securing method for securing a developing blade for a developing device, wherein said developing blade is effective to regulate toner to be applied on a developing roller, and said developing device includes a supporting member for supporting said developing blade; a mounting hole provided in one of said developing blade and said supporting member; a projection which is provided on the other of said developing blade and said supporting member and which is inserted in said mounting hole; a recess provided in said projection and extended from a free end portion of said projection toward a base portion of said projection, said method comprising inserting said projection into said mounting hole; injecting molten resin material into said recess to deform said projection so as to expand said recess outwardly of said mounting hole by a pressure of the resin material; and curing the resin material to secure said developing blade to said supporting member.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 7(*b*) is a schematic sectional view of the jig for attaching the metallic plate of the cleaning blade, the metallic plate of the cleaning blade, the cleaning unit frame, and one of the bosses of the cleaning unit frame, during the resin injection, in the first preferred embodiment. It shows the state of connection between the metallic plate and cleaning unit frame. FIG. 7(*c*) is a schematic sectional view of the jig for attaching the metallic plate of the cleaning blade, the metallic plate of the cleaning blade, the cleaning unit frame, and one of the bosses of the cleaning unit frame, after the resin injection, in the first preferred embodiment. It shows the state of connection between the metallic plate and cleaning unit frame.

FIG. 11(*b*) is a schematic sectional view of the jig for attaching the metallic plate of the cleaning blade, the metallic plate of the cleaning blade, the cleaning unit frame, and one of the bosses of the cleaning unit frame, during the resin injection, in the second preferred embodiment. It shows the state of connection between the metallic plate and cleaning unit frame. FIG. 11(*c*) is a schematic sectional view of the jig for attaching the metallic plate of the cleaning blade, the metallic plate of the cleaning blade, the cleaning unit frame, and one of the bosses of the cleaning unit frame, after the resin injection, in the second preferred embodiment. It shows the state of connection between the metallic plate and cleaning unit frame.

DETAILED DESCRIPTION OF THE PREFERRED EMBODIMENTS

Embodiment 1

Overall Structure of Image Forming Apparatus

Figure 1:
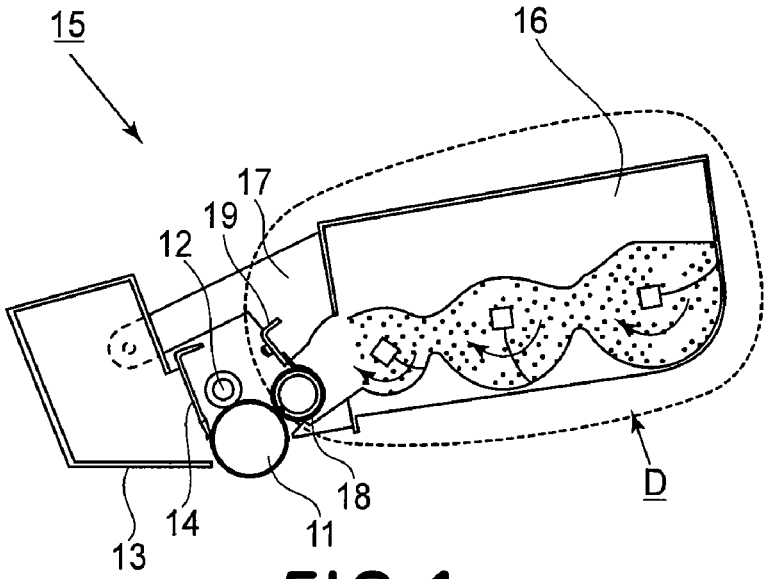
FIG. 1 is a sectional view of the process cartridge in the first preferred embodiment of the present invention, at a plane which corresponds in position to the most essential portion of the process cartridge.
Figure 2:
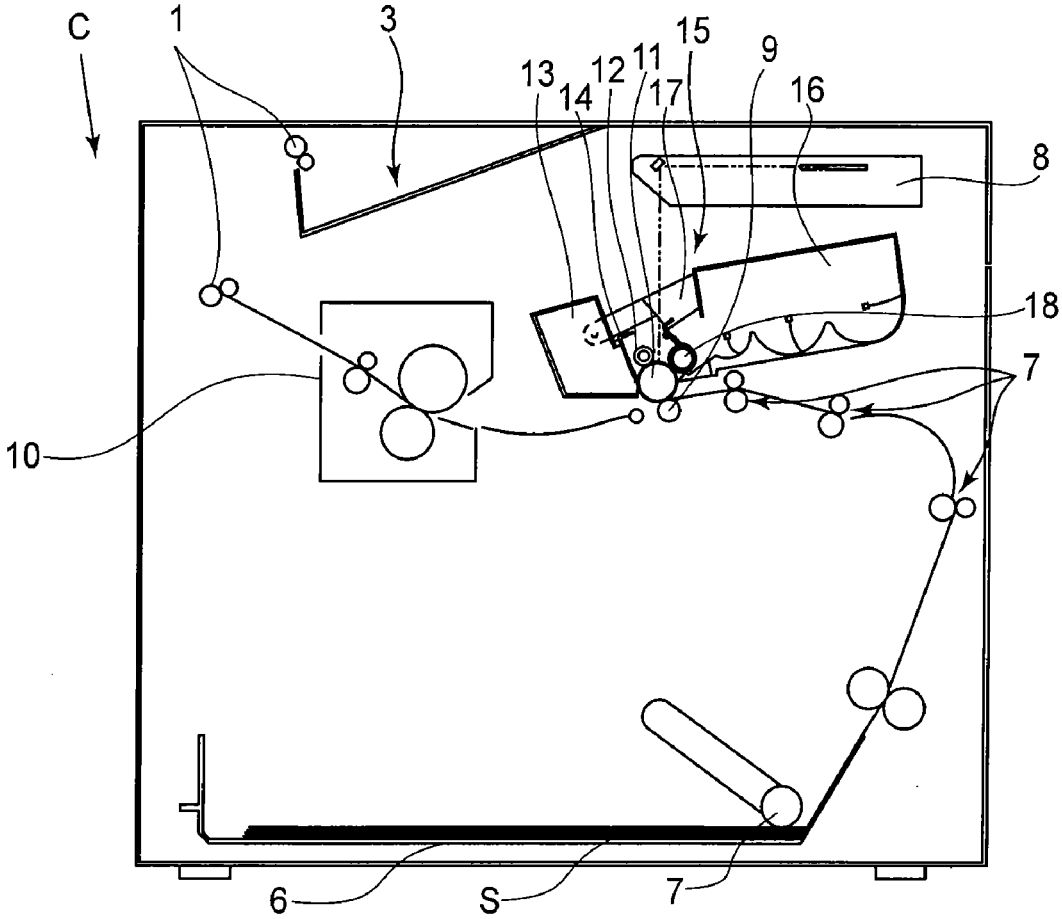
FIG. 2 is a sectional view of the image forming apparatus in the first preferred embodiment of the present invention, at a plane which corresponds in position to the most essential portion of the image forming apparatus.

FIG. 1 is a sectional view of the process cartridge, in the first preferred embodiment of the present invention, which has a development unit to which the present invention is applicable, at a plane which corresponds in position to the essential portion of the process cartridge. FIG. 2 is a sectional view of the image forming apparatus, in the first preferred embodiment of the present invention, to which the present invention is applicable, at a plane which corresponds in position to the essential portion of the image forming apparatus. The process cartridge in this embodiment is provided with an image bearing apparatus, and a processing means which processes the image bearing member. The cartridge is removably mountable in the image forming apparatus in FIG. 2. As the processing means, there are a charging means for charging the peripheral surface of the image bearing member, a developing device for forming an image on the image bearing member, and a cleaning device for removing the toner remaining on the peripheral surface of the image bearing member, for example.

Referring to FIG. 1, a process cartridge 15 has a photosensitive drum 11 and a charge roller 12. The photosensitive drum 11 holds a toner image. The charge roller 12 is a charging means, and is in the adjacencies of the peripheral surface of the photosensitive drum 11. The process cartridge 15 has also a development unit D (developing device), which has a development roller 18, a development blade 19, and a toner storage container 16 in which toner is stored. The process cartridge 15 has also an elastic cleaning blade 14 as a cleaning means. Further, the process cartridge 15 has a housing in which the abovementioned components are integrally held. It is removably mountable in the main assembly C of the image forming apparatus.

From a sheet cassette 6 mounted in the bottom portion of the main assembly C of the image forming apparatus, a sheet S of recording medium is conveyed into the main assembly C by a sheet conveyance roller 7. In synchronism with this conveyance of the sheet S, a latent image is formed on the peripheral surface of the photosensitive drum 11 by selectively exposing the numerous points of the peripheral surface of the photosensitive drum 11 with an exposing apparatus 8. Meanwhile, the toner in a toner storage container 16 is coated in a thin layer on the peripheral surface of the development roller 18 by the development blade 19 held by development unit frame 17. The toner is two-component toner, that is, a mixture of magnetic toner and magnetic carrier. The development blade 19 regulates the manner in which the toner is coated on the peripheral surface of the development roller 18. Then, the latent image is supplied (developed) with the toner by applying development bias to the development roller 18 as a developer bearing member. As a result, a visible image is formed on the peripheral surface of the photosensitive drum 11. Then, the toner image is transferred by the application of bias voltage to a transfer roller 9, from the photosensitive drum 11 onto the sheet S, which is being conveyed. Then, the sheet S is conveyed to a fixing apparatus 10, in which the toner image is fixed to the sheet S. Then, the sheet S is discharged by two pairs of discharge rollers 1 into a developer tray 3, which is a part of the top portion of the apparatus main assembly.

[Structure of Cleaning Unit]

Figure 3:
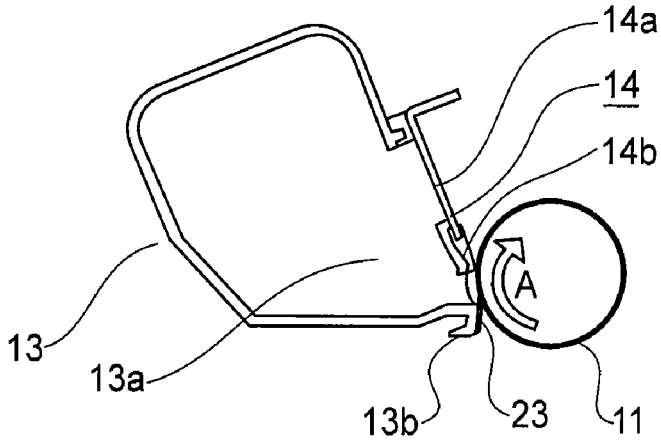
FIG. 3 is a sectional view of the cleaning unit in the first preferred embodiment of the present invention.
Figure 4:
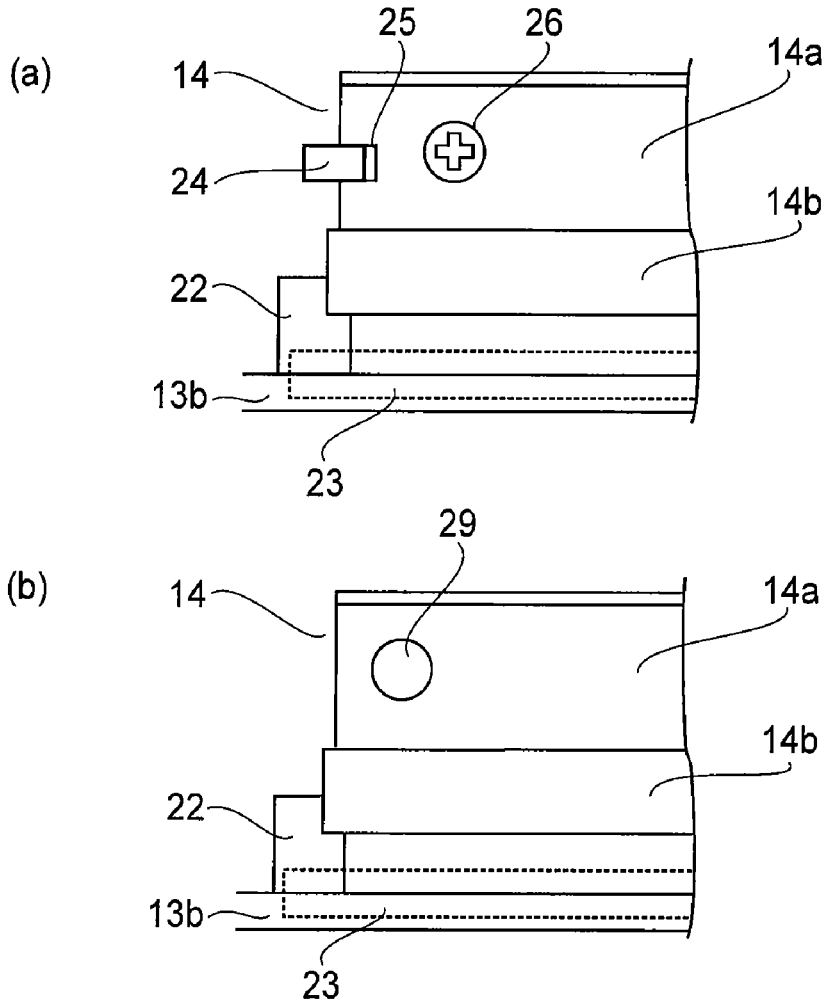
FIG. 4(*a*) is a drawing which shows the general structure of a conventional cleaning unit, and FIG. 4(*b*) is a drawing which shows the general structure of the cleaning unit in the first preferred embodiment.

Next, referring to FIGS. 3 and 4, the structure of the cleaning unit will be described in detail. FIG. 3 is a sectional view of the cleaning unit, and FIG. 4(*b*) is a front view of the cleaning unit. FIG. 4(*a*) is a front view of a conventional cleaning unit, and is provided for comparison.

As will be evident from FIGS. 3 and 4(*b*), the cleaning blade 14 is made up of a metallic plate 14*a* and a rubber portion 14*b*. The metallic plate 14*a* is solidly attached to the frame of the cleaning unit. The rubber portion 14*b* is attached to the metallic plate 14*a*. The material for the rubber portion 14*b* is polyurethane. The rubber portion 14*b* is in contact with the peripheral surface of the photosensitive drum 11. Thus, as the photosensitive drum 11 rotates in the direction indicated by an arrow mark A in FIG. 3, the rubber portion 14 removes the toner on the peripheral surface of the photosensitive drum 11. The removed toner is accumulated in a waste toner chamber 13*a*. The cleaning unit has an elastic sheet 23, which is pasted on the sheet supporting surface 13*b* of the cleaning unit frame 13. Thus, the toner remaining on the peripheral surface of the photosensitive drum 11 after the transfer of the toner image is guided into the waste toner chamber 13*a* by the elastic sheet 23. The elastic sheet 23 is kept lightly pressed upon the peripheral surface of the photosensitive drum 11 just enough to prevent the residual toner in the waste toner chamber 13*a* from passing between the sheet 23 and peripheral surface of the photosensitive drum 11.

[Solid Attachment of Cleaning Blade]

Next, the method for solidly attaching the cleaning blade 14 will be described. Conventionally, the cleaning blade 14 is attached to the cleaning unit frame 13 as shown in FIG. 4(*a*). That is, the cleaning blade 14 is precisely positioned relative to the cleaning unit frame 13 by engaging the cleaning blade positioning portion 25, with which the metallic plate 14*a* of the cleaning blade 14 is provided, with the cleaning blade positioning portion 24 of the cleaning unit frame 13. The cleaning blade positioning portion 24 of the cleaning unit frame 13 is a boss which is rectangular in cross section, whereas the cleaning blade positioning portion 25 of the cleaning blade 14 is a recess with which the metallic plate 14*a* of the cleaning blade 14 is provided. Thus, as these two cleaning blade positioning portions 24 and 25 engage with each other, the cleaning blade 14 is precisely positioned relative to the cleaning unit frame 13. Incidentally, in the case of some cleaning units, the cleaning blade 14 is precisely positioned by a combination of a round boss, and a round recess (unshown). The cleaning blade 14 is attached to the cleaning unit frame 13 by putting screws 26 through through holes of the metallic plate 14*a*, and a blind holes or through holes of the cleaning unit 13, and tightening the screws 26. Next, referring to FIGS. 4(*b*) and 8, in the case of the cleaning unit in this embodiment, the metallic plate 14*a* of the cleaning blade 14 is provided with the through holes 14*c* (blade attachment holes), whereas the cleaning unit frame 13 is provided with bosses 27. Thus, the cleaning blade 14 is attached to the cleaning unit frame 13 by positioning the cleaning blade 14 so that the bosses 27 fit in the holes 14*c* of the cleaning blade 14, and then, applying resin.

Figure 5:
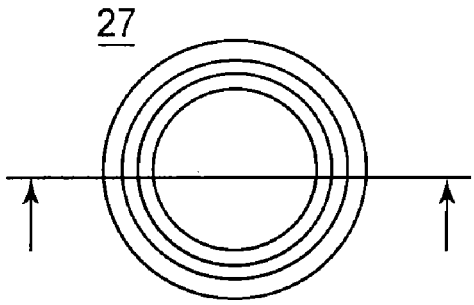
FIG. 5(*a*) is a top plan view of the one of the bosses of the cleaning unit frame in the first preferred embodiment of the present invention, and FIG. 5(*b*) is a perspective view of one of the bosses of the cleaning unit frame in the first preferred embodiment of the present invention.
Figure 5:
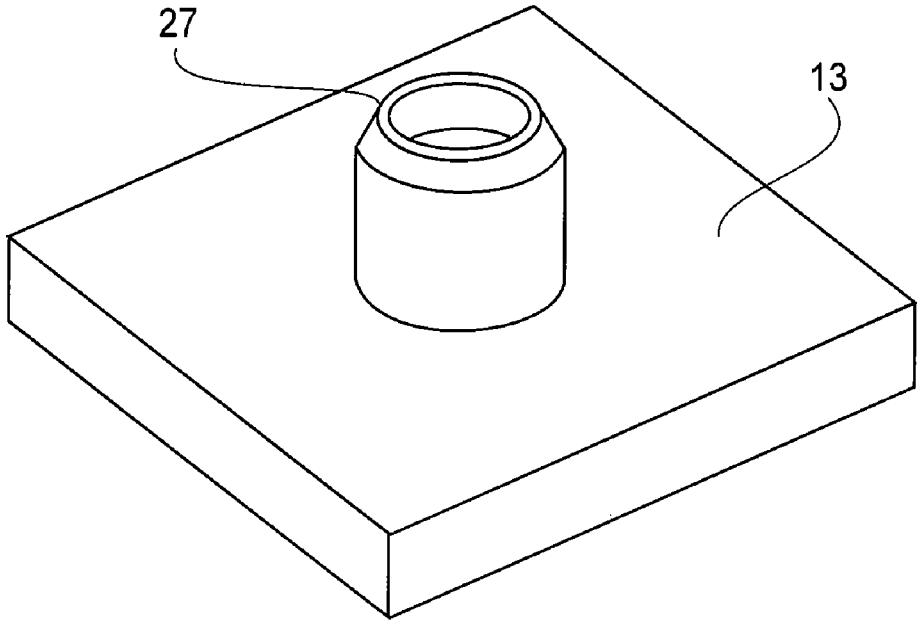
Figure 6:
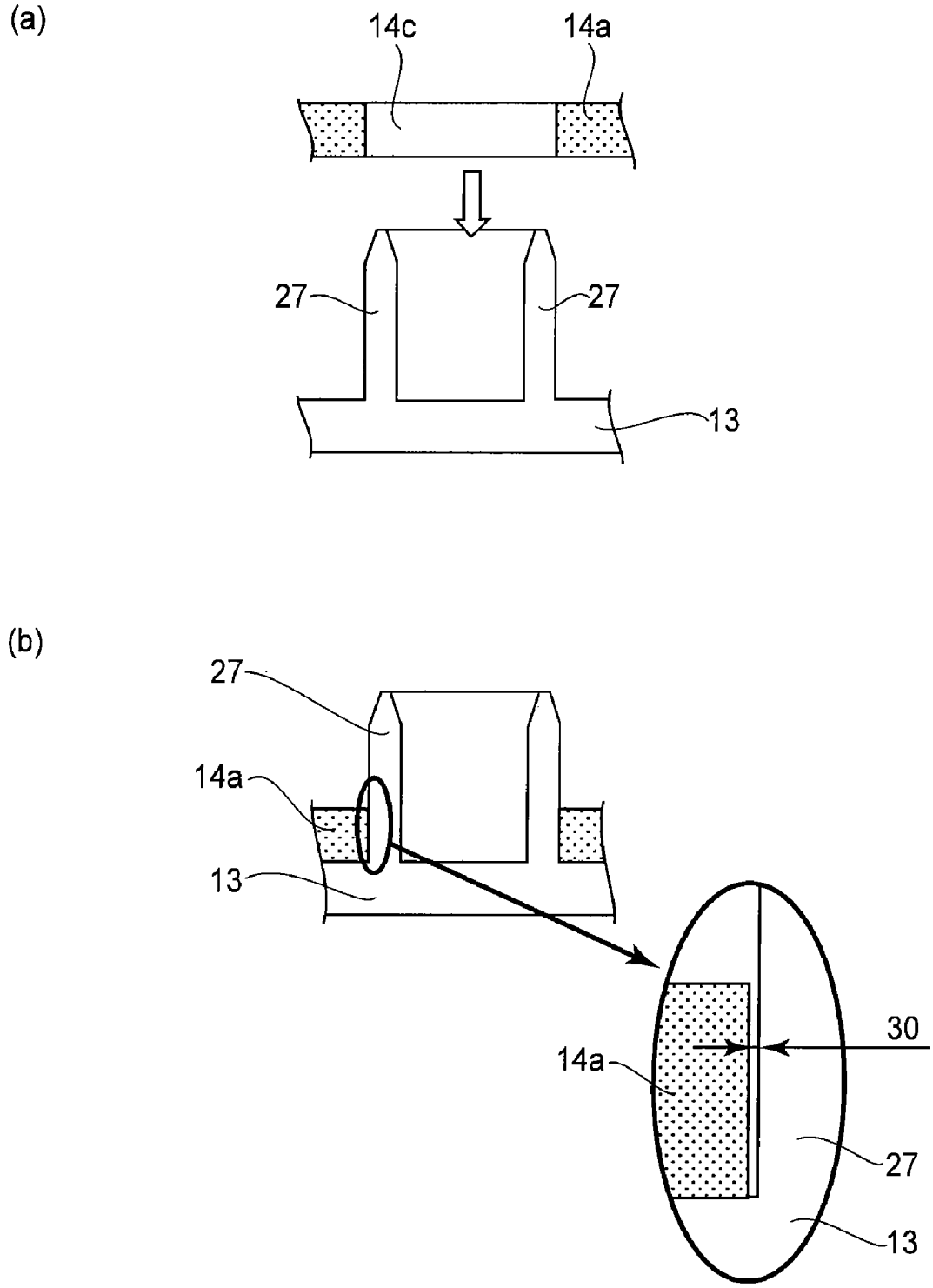
FIG. 6(*a*) is a schematic sectional view of a combination of the metallic plate of the cleaning blade, the cleaning unit frame, and one of the bosses of the cleaning unit frame, in the first preferred embodiment of the present invention, and FIG. 6(*b*) is an enlarged sectional view of the combination of the metallic plate of the cleaning blade, cleaning unit frame, and one of the bosses of the cleaning unit frame, in the first preferred embodiment of the present invention.

Next, the attachment of the cleaning blade 14 to the cleaning unit frame 13, to which the cleaning blade 14 is to be attached, in this preferred embodiment of the present invention, will be described in detail. FIGS. 5(*a*) and 5(*b*) show one of the bosses for attaching the cleaning blade 14 to the cleaning unit frame 13. FIG. 6(*a*) shows the metallic plate 14*a* and one of the bosses (protrusions) of the cleaning unit frame 13, in this embodiment, prior to the attachment of the cleaning blade 14. FIG. 5(*a*) is a top plan view of the boss 27, and FIG. 5(*b*) is a perspective view of the boss 27. FIG. 6(*a*) is a sectional view of the metallic plate 14*a* and boss 27, at a plane indicated in FIG. 5(*a*) by a single-dot chain line. FIG. 6(*b*) is a sectional view of the metallic plate 14*a* and boss 27 when the boss 27 is in the hole 14*c* of the metallic plate 14*a*.

Figure 7:
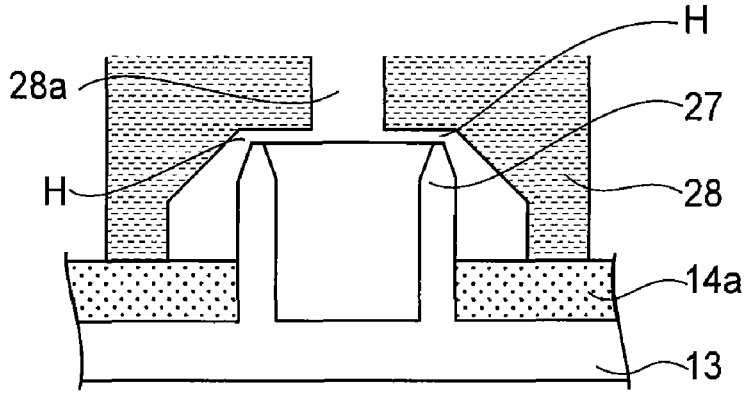
FIG. 7(*a*) is a schematic sectional view of the jig for attaching the metallic plate of the cleaning blade, the metallic plate of the cleaning blade, the cleaning unit frame, and one of the bosses of the cleaning unit frame, prior to the resin injection, in the first preferred embodiment. It shows the state of connection between the metallic plate and cleaning unit frame.
Figure 7:
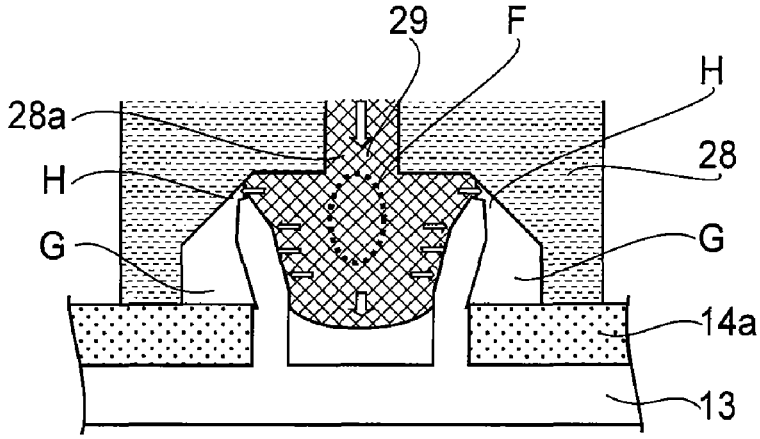
Figure 7:
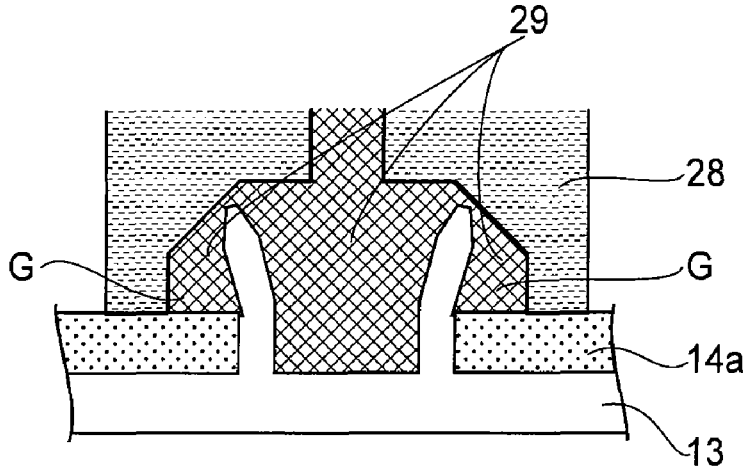
Figure 8:
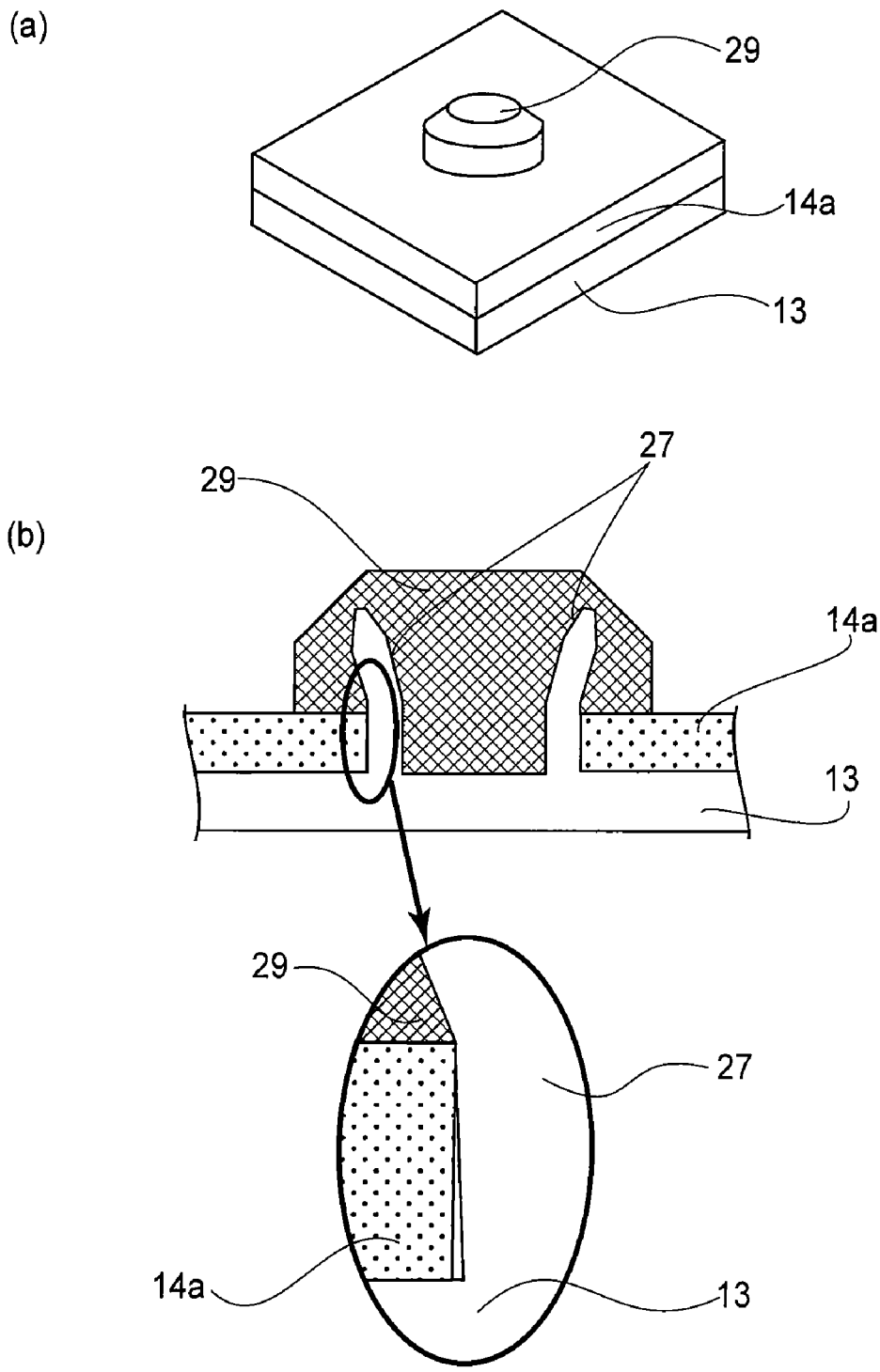
FIG. 8(*a*) is a perspective view of a combination of the solidified body of resin, one of the bosses of the cleaning unit frame, the metallic plate of the cleaning blade, and the cleaning unit frame, after the completion of the process of attaching the metallic plate to the cleaning unit frame, in the first preferred embodiment of the present invention, and FIG. 8(*b*) is a sectional view of the combination of the solidified body of resin, one of the bosses of the cleaning unit frame, the metallic plate of the cleaning blade, and the cleaning unit frame, after the completion of the process of attaching the metallic plate to the boss of the cleaning unit frame, in the first preferred embodiment of the present invention.

The metallic plate 14*a* of the cleaning blade 14 has the cleaning blade attachment holes 14*c*. The cleaning unit frame 13 has the bosses 27, with which the metallic plate 14*a* is solidly attached to the cleaning unit frame 13. Each boss 27 is cylindrical and hollow. That is, the end portion of the boss 27 is a cylindrical blind hole, which extends inward from the tip of the boss 27. The cylindrical wall of the boss 27 is thinner than the wall of the main structure of the cleaning unit frame 13. The metallic plate 14*a* is placed on the cleaning unit frame 13 so that the bosses 27 come through the cleaning blade attachment holes 14*c*, one for one (FIG. 6), with the presence of a minute gap 30 between each boss 27 and the wall of the corresponding hole 14*c*, because the boss 27 is slightly smaller in cross section than the hole 14*c* (FIG. 6(*b*); enlarged view). Next, an resin injection jig 28 is placed on the metallic plate 14*a* so that the boss 27 and hole 14*c* are covered with the jig 28, as shown in FIG. 7(*a*). The resin injection jig 28 has a resin injection hole 28*a*, which is in the middle of the top wall of the jig 28, and through which melted resin 29 is injected inward of the jig 28. It also has a space in which the boss 27 and hole 14*c* will be as the jig 28 is placed on the metallic plate 14*a*. The melted resin 29 is injected inward of the jig 28 through the abovementioned center hole 28*a*. Since the melted resin 29 (which will cool down and become solid resin 29 after injection) is injected through the center hole 28*a*, the melted resin 29 flows into the adjacencies of the center portion F (portion covered with dots) of the boss 27 (FIG. 7(*b*)). The wall of the boss 27 is thin as described above. Therefore, as the melted resin 29 is injected, the boss 27 outwardly deforms because of the pressure from the melted resin 29. Then, the injected melted resin 29 flows into an area G, which is the outward adjacency of the boss 27, through a gap H which is between the top of the boss 27 and the inward surface of the jig 28, and fills the abovementioned internal space of the jig 28 (FIG. 7(*c*)). Then, the jig 28 is moved away, ending thereby the process of attaching the metallic plate 14*a* to the cleaning unit frame 13 (FIGS. 8(*a*), 8(*b*), and 8(*c*)). As the injected melted resin 29 fills the center hole of the boss 27, surrounds the adjacencies of the hole 14*c* of the metallic plate 14*a*, and solidifies, the metallic plate 14*a* becomes solidly attached to the cleaning unit frame 13. Further, as the melted resin 29 is injected, the bottom portion of the wall of the boss 27 is expanded as wide as the diameter of the hole 14*c* of the metallic plate 14*a* by the pressure from the injected melted resin 29 as described above. Thus, the metallic plate 14*a* is precisely positioned in terms of the diameter direction of the hole 14*c* of the metallic plate 14 as well (FIG. 8(*b*); enlarged view).

In this embodiment, the metallic plate 14*a* is solidly attached to the cleaning unit frame 13 with the use of resin, making it possible to eliminate the screws which have been used in the case of the conventional method for attaching the metallic plate 14*a*. Therefore, the abovementioned metallic nuisance (tiny pieces of metal) which might result from the usage of the screws does not occur. Further, the two portions, that is, the positioning portion and attachment portion, which the conventional method for attaching the cleaning blade to the cleaning unit frame require, do not need to be separately provided. That is, in the case of the cleaning blade attaching method in this embodiment, both the metallic plate positioning function and metallic plate attaching function are provided by the same combination of components (boss and corresponding hole), making it possible to reduce the cleaning unit in size, and also, affording more latitude when designing an image forming apparatus (cleaning unit).

Incidentally, in this preferred embodiment, the cleaning unit frame 13 is provided with the bosses 27, and the cleaning blade 14 is provided with the blade attachment hole 14*c*. Instead, however, the cleaning unit frame 13 may be provided with the blade attachment holes, and the cleaning blade 14 may be provided with the cleaning blade attachment bosses. That is, all that is necessary is that one of the cleaning blade 14 and cleaning unit frame 13 is provided with the holes 14*c*, and the other is provided with the bosses.

Embodiment 2

Figure 9:
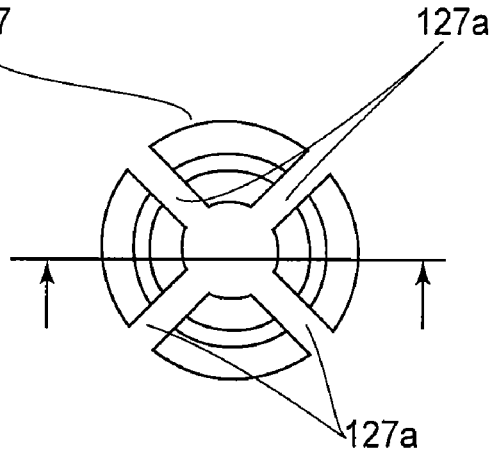
FIG. 9(*a*) is top plan view of one of the bosses of the cleaning unit frame in the second preferred embodiment of the present invention, and FIG. 9(*b*) is a perspective view of one of the bosses of the cleaning unit frame in the second preferred embodiment of the present invention.
Figure 9:
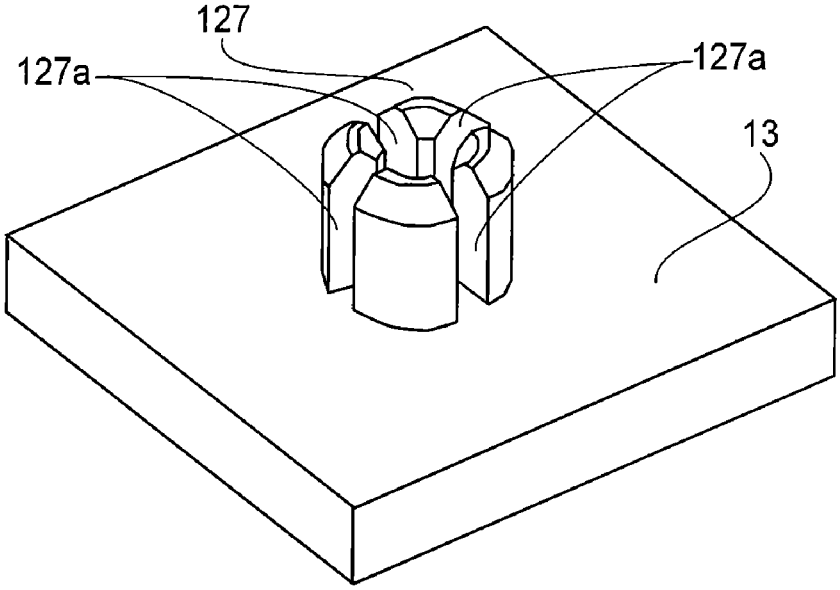

Shown in FIGS. 9(*a*) and 9(*b*) is another preferred embodiment of the present invention. In this preferred embodiment, each of the bosses 127 has four vertical slits which are distributed with even intervals in the circumferential direction of the boss 127. Each slit extends from the tip of the boss 127 to the bottom of the boss 127. In other words, the boss 127 has a cylindrical central hole 14*c*, which is similar to the cylindrical central hole 14*c* of the boss 27 in the first preferred embodiment, and four slits (gaps) which extend from the center hole 14*c* to the peripheral surface of the boss 127.

Figure 10:
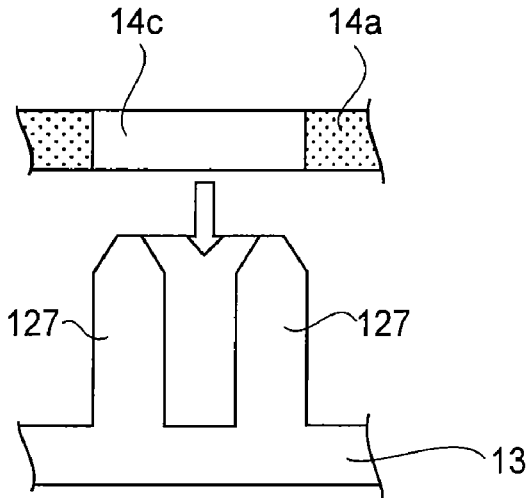
FIG. 10(*a*) is a schematic sectional view of a combination of the metallic plate of the cleaning blade, the cleaning unit frame, and one of the bosses of the cleaning unit frame, in the second preferred embodiment of the present invention, and FIG. 10(*b*) is a sectional view, including a partial enlargement, of the combination of the metallic plate of the cleaning blade, the cleaning unit frame, and one of the bosses of the cleaning unit frame, in the second preferred embodiment of the present invention.
Figure 10:
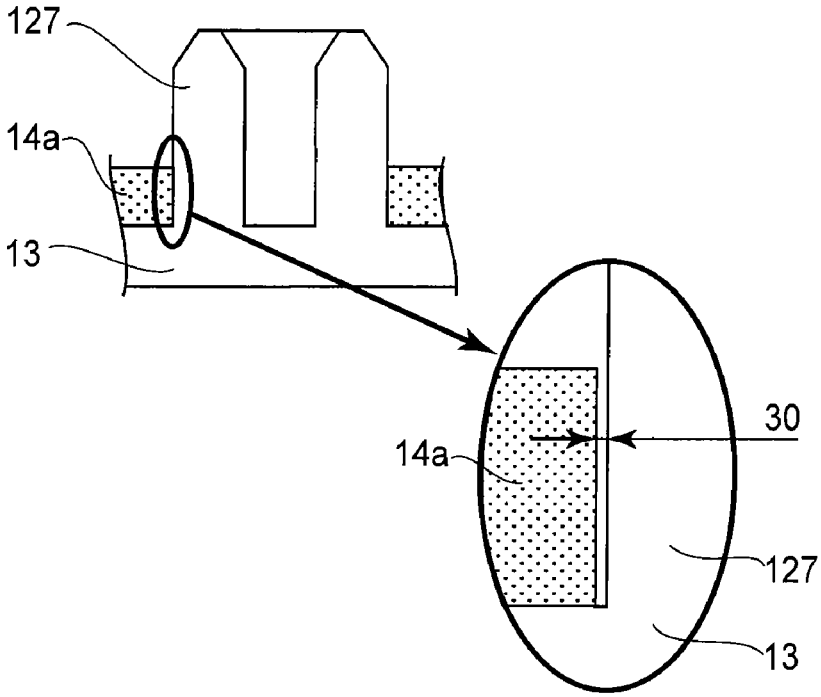

First, the metallic plate 14*a* is placed against the cleaning unit frame 13 so that each boss 127 fits in the corresponding hole 14*c* of the metallic plate 14*a* (FIGS. 10(*a*) and 10(*b*)). Incidentally, the boss 127 is slightly smaller in diameter than the hole 14*c*. Thus, as the boss 127 fits in the hole 14*c*, a small gap 30 remains between the peripheral surface of the boss 127 and the inward surface of the hole 14*c* of the metallic plate 14*a* (FIG. 10(*b*); enlarged view).

Figure 11:
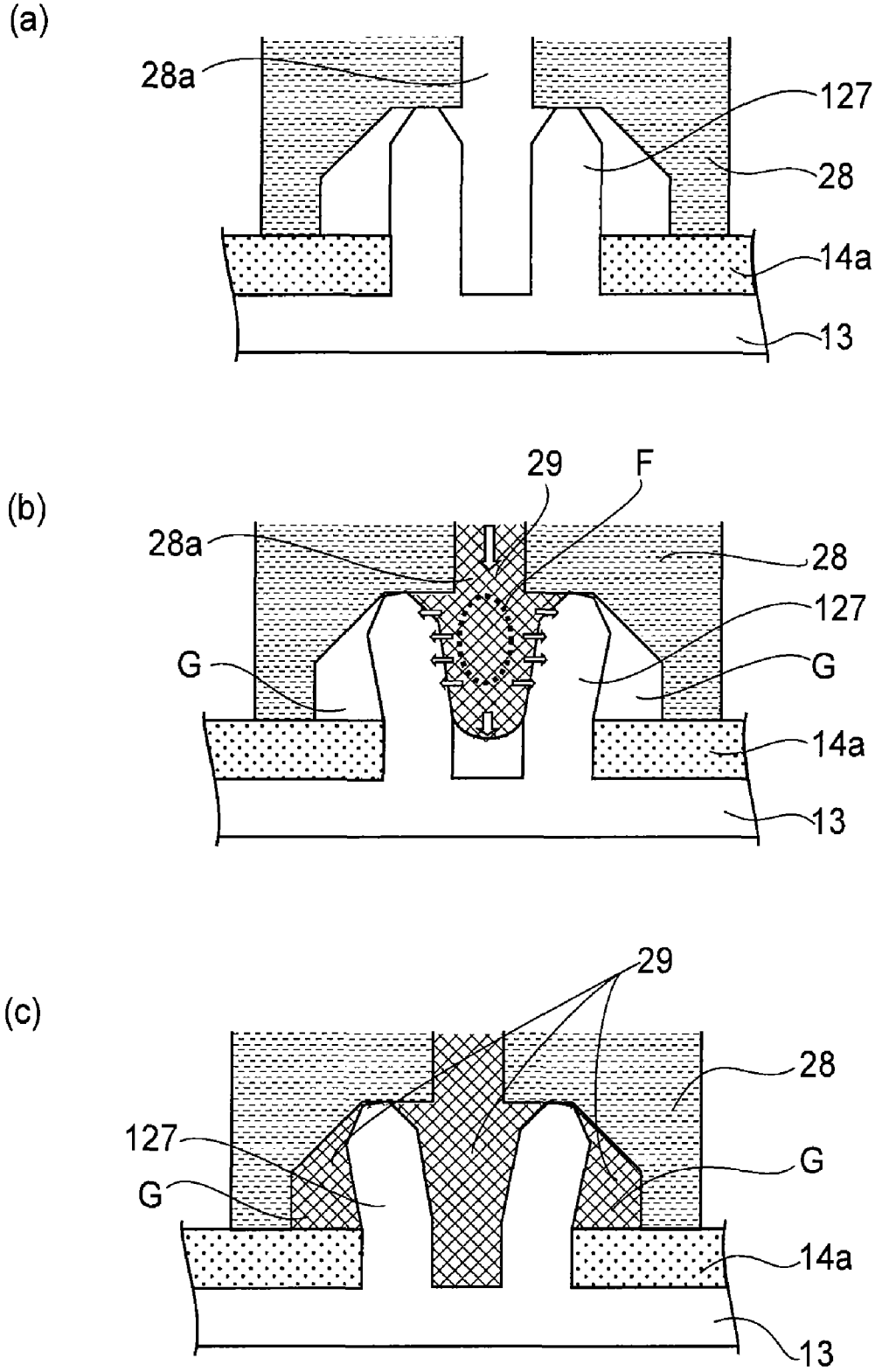
FIG. 11(*a*) is a schematic sectional view of the jig for attaching the metallic plate of the cleaning blade, the metallic plate of the cleaning blade, the cleaning unit frame, and one of the bosses of the cleaning unit frame, prior to the resin injection, in the second preferred embodiment. It shows the state of connection between the metallic plate and cleaning unit frame.
Figure 12:
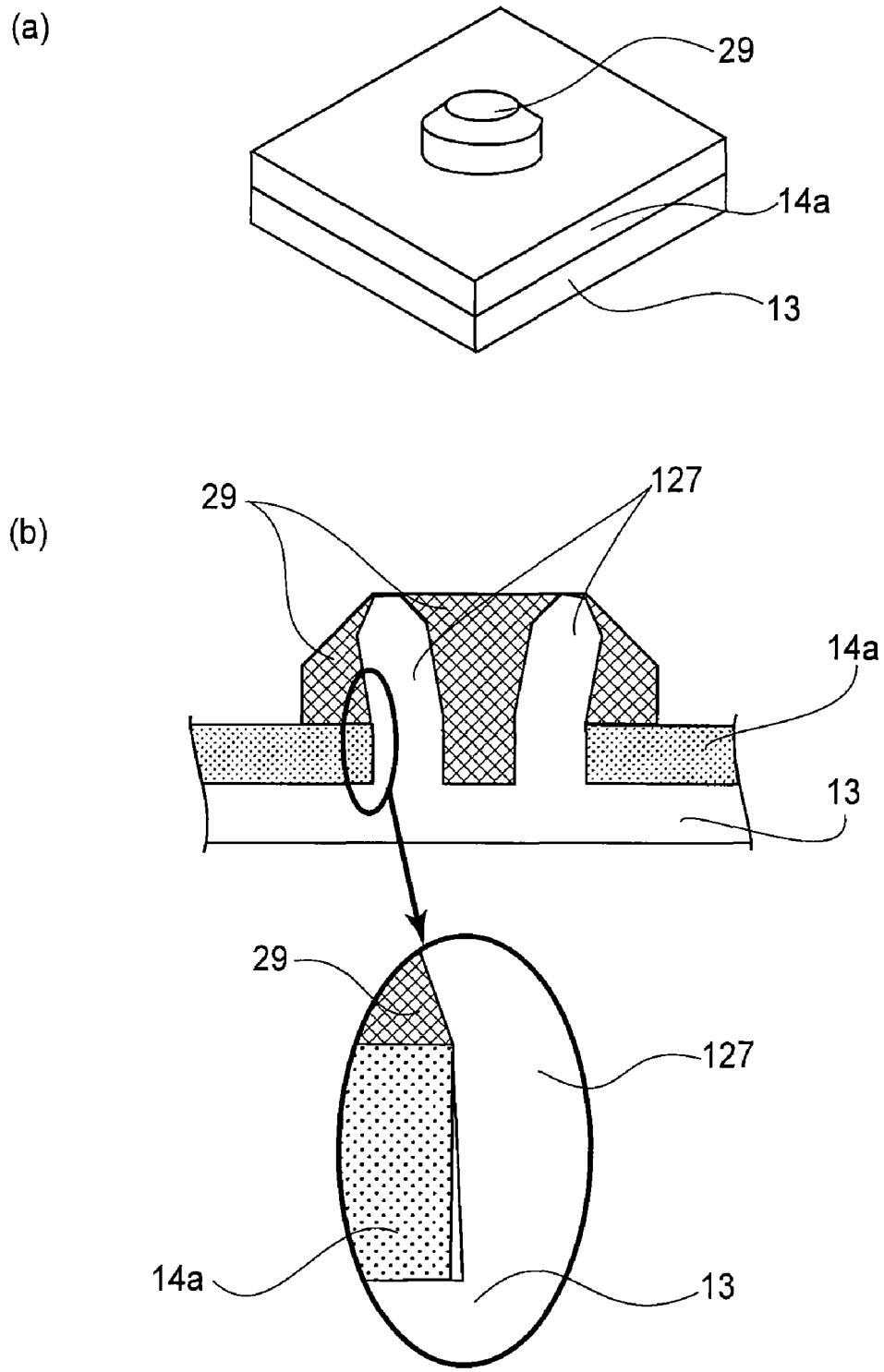
FIG. 12(*a*) is a perspective view of a combination of the solidified body of resin, one of the bosses of the cleaning unit frame, the metallic plate of the cleaning blade, and the cleaning unit frame, after the completion of the process of attaching the metallic plate to the cleaning unit frame, in the second preferred embodiment of the present invention, and FIG. 12(*b*) is a sectional view, including an enlarge view, of the combination of the solidified body of resin, one of the bosses of the cleaning unit frame, the metallic plate of the cleaning blade, and the cleaning unit frame, after the completion of the process of attaching the metallic plate to the cleaning unit frame the boss, in the second preferred embodiment of the present invention.

Next, the resin injection jig 28 is placed on the metallic plate 14*a* so that the boss 127 and hole 14*c* are covered with the jig 28, as shown in FIG. 11(*a*). The resin injection jig 28 has a resin injection hole 28*a*, which is in the middle of the top wall of the jig 28, and through which melted resin 29 is injected inward of the jig 28. The jig 28 has also a space in which the boss 127 and hole 14*c* will be as the jig 28 is placed on the metallic plate 14*a*. The melted resin 29 is injected inward of the jig 28 through the abovementioned center hole 28*a*. Since the melted resin 29 (which will cool down and become solid resin 29 after injection) is injected through the center hole 28*a*, the melted resin 29 flows into the adjacencies of the center portion F (portion covered with dots) of the boss 127 (FIG. 11(*b*)). As the melted resin 29 is injected, the boss 127 outwardly deforms by being pressed outward by the pressure from the melted resin 29. Then, the injected melted resin 29 flows into the area G, which is the outward adjacency of the peripheral surface of the boss 127, through the slits 127*a*, and fills the abovementioned internal space of the jig 28 (FIG. 11(*c*)). Then, the jig 28 is moved away, ending thereby the process of attaching the metallic plate 14*a* to the cleaning unit frame 13 (FIGS. 12(*a*) and 12(*b*)). As the injected melted resin 29 fills the center hole of the boss 127, surrounds the adjacencies of the hole 14*c* of the metallic plate 14*a*, and solidifies, the metallic plate 14*a* becomes solidly attached to the cleaning unit frame 13. Further, as the melted resin 29 is injected, the bottom portion of the wall of the boss 127 is expanded as wide as the diameter of the hole 14*c* of the metallic plate 14*a* by the pressure from the injected melted resin 29 as described above. Thus, the metallic plate 14*a* is precisely positioned in terms of the diameter direction of the hole 14*c* of the metallic plate 14*a* as well (FIG. 12(*b*); enlarged view). In other words, the second preferred embodiment can provide the same effects as those provided by the first preferred embodiment. In addition, the boss 127 in this embodiment is provided with the slits 127*a*. Therefore, it more easily deforms during the injection of the resin 29. In this embodiment, therefore, even if the pressure generated by the injection of the resin 29 is lower, the metallic plate 14*a* is precisely positioned relative to the cleaning unit frame 13.

Embodiment 3

Figure 13:
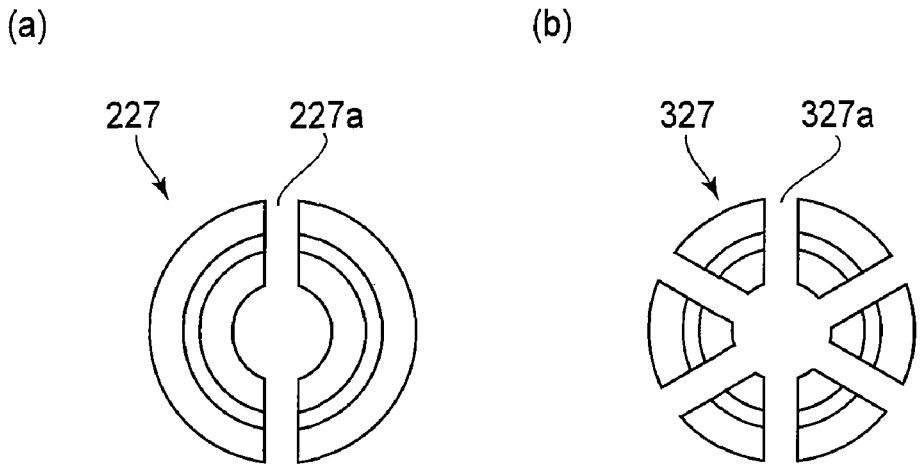
FIG. 13(*a*) is a top plan view of one of the bosses of the cleaning unit frame, which is made up of two equal pieces (halves), in the third preferred embodiment of the present invention, and FIG. 13(*b*) is a top plan view of one of the bosses of the cleaning unit frame, which is made up of six equal pieces.

The number of pieces into which each of the bosses of the cleaning unit 13 is to be split does not need to be four as it is in the second preferred embodiment. That is, each boss may be split into two pieces (FIG. 13(*a*)) like each of the bosses 227, or more than four pieces (FIG. 13(*b*)) like each of the bosses 327, in this preferred embodiment. The same effects as those obtained in the first and second preferred embodiments can also be obtained even in the case where each of the bosses of the cleaning unit frame are split into two pieces, or four or more pieces.

Embodiment 4

Figure 14:
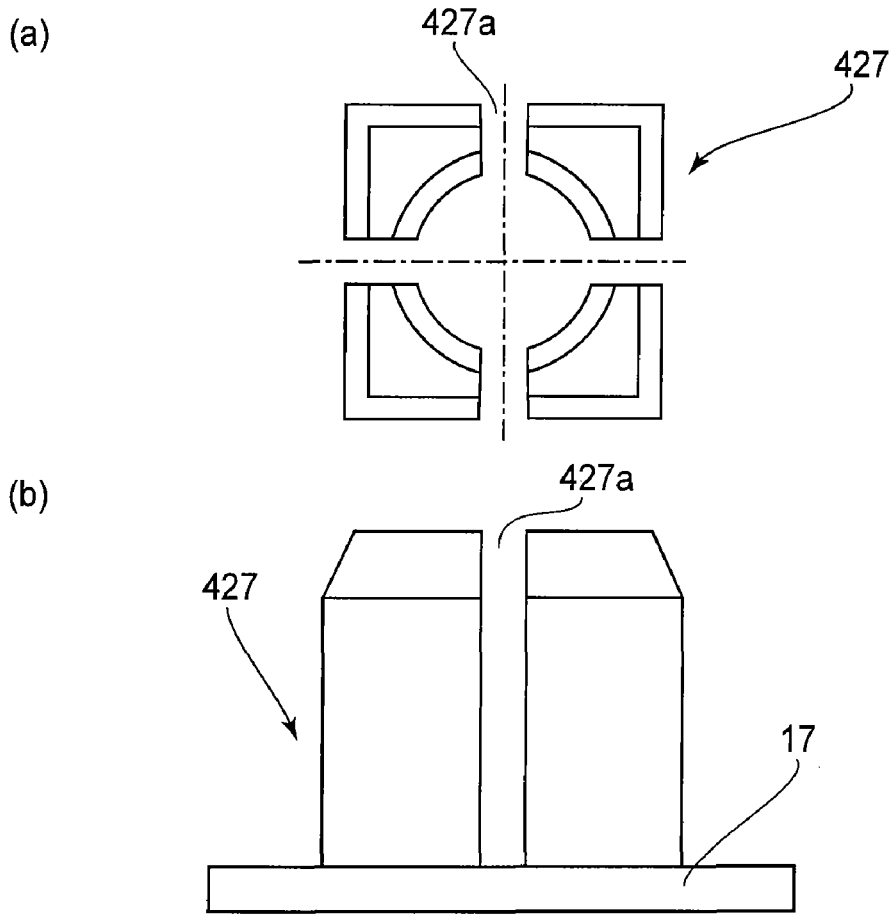
FIG. 14(*a*) is a top plan view of the boss in the fourth preferred embodiment of the present invention, and FIG. 14(*b*) is a side view of the boss in the fourth preferred embodiment of the present invention.

The bosses of the cleaning unit frame may be square (FIG. 14) in cross section, instead of being circular. In this embodiment, each boss is square in cross section, and has multiple (four) sections separated by multiple (four) slits 427*a*. The same effects as those obtainable in the first and second preferred embodiments can also be obtained by a boss such as the boss 427 in this embodiment.

Embodiment 5

Figure 15:
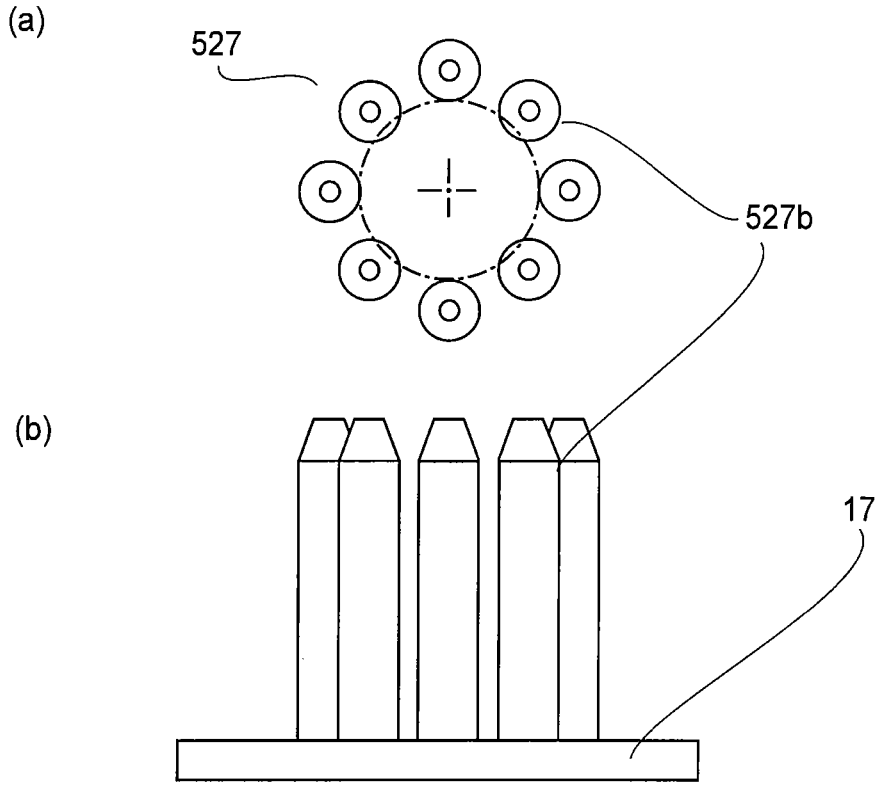
FIG. 15(*a*) is a top plan view of one of the bosses of the cleaning unit frame in the fifth preferred embodiment of the present invention, and FIG. 15(*b*) is a side view of the boss in FIG. 15(*a*), in the fifth preferred embodiment of the present invention.

Instead of structuring each of the bosses of the cleaning unit frame as if it is split into four pieces by a cross, each boss may be made up of multiple smaller bosses like the eight smaller bosses 527*b*, in this embodiment, which are roughly circularly positioned (FIG. 15). The same effects as those obtainable in the first and second preferred embodiment can also be obtained even if each of the bosses of the cleaning unit frame is made up of smaller bosses like the bosses 527*b*, in this embodiment, which are roughly circularly positioned.

Embodiment 6

Figure 16:
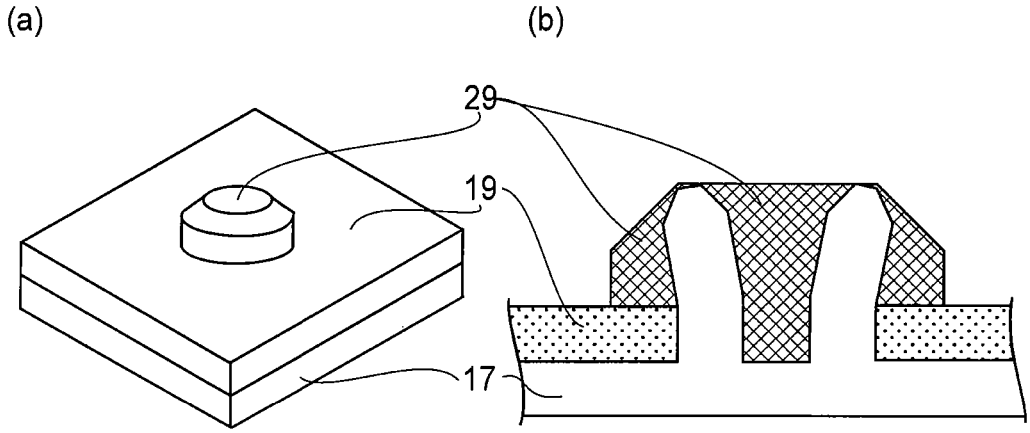
FIG. 16(*a*) is a perspective view of a combination of the solidified resin, one of the bosses of the development unit frame, the metallic plate of the development blade, and the development unit frame, in the sixth preferred embodiment of the present invention, and FIG. 16(*b*) is a sectional view of the combination in FIG. 16(*a*), in the sixth preferred embodiment of the present invention.

In the preceding preferred embodiments of the present invention, the metallic plate 14*a* is solidly attached to the cleaning unit frame 13 to solidly attach the cleaning blade 14 to the cleaning unit frame 13. However, the present invention can be applied to attach a development blade 19 to a developing device frame 17 (FIGS. 16(*a*) and 16(*b*)). In such a case, effects similar to those obtained in the first preferred embodiment can be obtained by replacing the cleaning blade 14 and cleaning unit frame 13 with the development blade 19 and developing unit frame 17, respectively. Further, the development blade 19 can be solidly attached to the developing unit frame 17 with the use of bosses like those in the first, second, third, fourth, and fifth preferred embodiments.

In this (sixth) preferred embodiment, the development unit frame 17 is provided with the bosses, and the development blade 19 is provided with the development blade attachment holes. Instead, however, it may be the development unit frame 17 and development blade 19 that are provided with the development blade attachment holes and bosses, respectively.

Further, the preceding preferred embodiments of the present invention were described with reference to the cartridges which are removably mountable in the main assembly of an image forming apparatus. However, the present invention is applicable also to a cleaning device or developing device which is solidly attached to the main assembly of an image forming apparatus. Further, the present invention is applicable to a cleaning device or developing device which is structured so that it is removably mountable in the main assembly of an image forming apparatus.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 046386/2009 and 286066/2009 filed Feb. 27, 2009 and Dec. 17, 2009, respectively, which are hereby incorporated by reference.

What is claimed is:

1. A cleaning device comprising:

a cleaning blade for removing toner remaining on a surface of an image bearing member for carrying a toner image;

a supporting member for supporting said cleaning blade;

a mounting hole provided in one of said cleaning blade and said supporting member;

a projection which is provided on the other of said cleaning blade and said supporting member and which is inserted in said mounting hole; and a recess provided in said projection and extended from a free end portion of said projection toward a base portion of said projection, wherein said cleaning blade and said supporting member are secured to each other by deformation of said projection by resin material in said recess such that said recess expands outwardly of said mounting hole, and said resin material covers an outer periphery of said projection.

2. The cleaning device according to claim 1, wherein said projection is provided around said recess with a slit extended from the free end portion toward the base portion.

3. The cleaning device according to claim 1, wherein said projection and said recess are provided by a plurality of projections arranged along an inner surface of said mounting hole.

4. A cartridge detachably mountable to a main assembly of an image forming apparatus, wherein said cartridge comprises the cleaning device according to claim 1.

5. A developing device comprising:

a developing blade for regulating toner to be applied on a developing roller;

a supporting member for supporting said developing blade;

a mounting hole provided in one of said developing blade and said supporting member;

a projection which is provided on the other of said developing blade and said supporting member and which is inserted in said mounting hole; and a recess provided in said projection and extended from a free end portion of said projection toward a base portion of said projection, wherein said developing blade and said supporting member are secured to each other by deformation of said projection by resin material in said recess such that said recess expands outwardly of said mounting hole, and said resin material covers an outer periphery of said projection.

6. The developing device according to claim 5, wherein said projection is provided around said recess with a slit extended from the free end portion toward the base portion.

7. The developing device according to claim 5, wherein said projection and said recess are provided by plurality of projections arranged along an inner surface of said mounting hole.

8. A cartridge detachably mountable to a main assembly of an image forming apparatus, wherein said cartridge comprises the developing device according to claim 5.

* * * * *